US006601351B1

(12) United States Patent
Zerfoss

(10) Patent No.: US 6,601,351 B1
(45) Date of Patent: Aug. 5, 2003

(54) PIPE FLANGE SYSTEM

(76) Inventor: Dee J. Zerfoss, 2427 Lexington Ave., Everett, WA (US) 98203

( * ) Notice: Subject to any disclaimer, the term of this patent is extended or adjusted under 35 U.S.C. 154(b) by 0 days.

(21) Appl. No.: 10/056,332

(22) Filed: Jan. 25, 2002

(51) Int. Cl.[7] ..... E04B 7/00; E04H 12/28

(52) U.S. Cl. ..... 52/198; 52/58; 52/60; 285/43; 285/44; 285/42

(58) Field of Search ..... 52/219, 58, 220.8, 52/198, 60; 285/43, 44, 42

(56) References Cited

U.S. PATENT DOCUMENTS 2,800,850 A 7/1957 Mc Kann
D216,683 S 3/1970 Gilbert
4,864,782 A 9/1989 Hasty
4,937,991 A * 7/1990 Orth ..... 52/199
5,226,263 A * 7/1993 Merrin et al. ..... 52/58
5,536,048 A * 7/1996 Orr ..... 285/42
5,946,863 A * 9/1999 Bullard ..... 52/58
5,970,667 A * 10/1999 Thaler ..... 52/219

* cited by examiner

*Primary Examiner*—Carl D. Friedman
*Assistant Examiner*—Steve Varner

(57) ABSTRACT

A pipe flange system for facilitating replacement of flashing around an electrical service entrance pipe on a roof. The pipe flange system includes a lower flange assembly for engaging a service entrance pipe which includes a lower base portion designed for resting upon a slant roof and a lower conical portion for engaging a portion of a perimeter wall of the service entrance pipe; and an upper flange assembly for engaging the service entrance pipe which includes an upper base portion designed for resting upon a slant roof and an upper surface of the lower flange assembly and an upper conical portion for engaging a second portion of the perimeter wall of the service entrance pipe.

9 Claims, 3 Drawing Sheets

PIPE FLANGE SYSTEM

BACKGROUND OF THE INVENTION

1. Field of the Invention

The present invention relates to flashing assemblies and more particularly pertains to a new pipe flange system for facilitating replacement of flashing around an electrical service entrance pipe on a roof.

2. Description of the Prior Art

The use of flashing assemblies is known in the prior art. More specifically, flashing assemblies heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,800,850; U.S. Pat. No. 4,937,991; U.S. Pat. No. 4,864,782; U.S. Pat. No. 5,970,667; U.S. Pat. No. 5,946,863; and U.S. Pat. No. Des. 216,683.

While these devices fulfill their respective, particular objectives and requirements, the aforementioned patents do not disclose a new pipe flange system. The inventive device includes a lower flange assembly for engaging a service entrance pipe which includes a lower base portion designed for resting upon a slant roof and a lower conical portion for engaging a portion of a perimeter wall of the service entrance pipe; and an upper flange assembly for engaging the service entrance pipe which includes an upper base portion designed for resting upon a slant roof and an upper surface of the lower flange assembly and an upper conical portion for engaging a second portion of the perimeter wall of the service entrance pipe.

In these respects, the pipe flange system according to the present invention substantially departs from the conventional concepts and designs of the prior art, and in so doing provides an apparatus primarily developed for the purpose of facilitating replacement of flashing around an electrical service entrance pipe on a roof.

SUMMARY OF THE INVENTION

In view of the foregoing disadvantages inherent in the known types of flashing assemblies now present in the prior art, the present invention provides a new pipe flange system construction wherein the same can be utilized for facilitating replacement of flashing around an electrical service entrance pipe on a roof.

The general purpose of the present invention, which will be described subsequently in greater detail, is to provide a new pipe flange system apparatus and method which has many of the advantages of the flashing assemblies mentioned heretofore and many novel features that result in a new pipe flange system which is not anticipated, rendered obvious, suggested, or even implied by any of the prior art flashing assemblies, either alone or in any combination thereof.

To attain this, the present invention generally comprises a lower flange assembly for engaging a service entrance pipe which includes a lower base portion designed for resting upon a slant roof and a lower conical portion for engaging a portion of a perimeter wall of the service entrance pipe; and an upper flange assembly for engaging the service entrance pipe which includes an upper base portion designed for resting upon a slant roof and an upper surface of the lower flange assembly and an upper conical portion for engaging a second portion of the perimeter wall of the service entrance pipe.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pipe flange system apparatus and method which has many of the advantages of the flashing assemblies mentioned heretofore and many novel features that result in a new pipe flange system which is not anticipated, rendered obvious, suggested, or even implied by any of the prior art flashing assemblies, either alone or in any combination thereof.

It is another object of the present invention to provide a new pipe flange system which may be easily and efficiently manufactured and marketed.

It is a further object of the present invention to provide a new pipe flange system which is of a durable and reliable construction.

An even further object of the present invention is to provide a new pipe flange system which is susceptible of a low cost of manufacture with regard to both materials and labor, and which accordingly is then susceptible of low prices of sale to the consuming public, thereby making such pipe flange system economically available to the buying public.

Still yet another object of the present invention is to provide a new pipe flange system which provides in the apparatuses and methods of the prior art some of the advantages thereof, while simultaneously overcoming some of the disadvantages normally associated therewith.

Still another object of the present invention is to provide a new pipe flange system for facilitating replacement of flashing around an electrical service entrance pipe on a roof.

Yet another object of the present invention is to provide a new pipe flange system which includes a lower flange assembly for engaging a service entrance pipe which includes a lower base portion designed for resting upon a slant roof and a lower conical portion for engaging a portion of a perimeter wall of the service entrance pipe; and an upper flange assembly for engaging the service entrance pipe which includes an upper base portion designed for resting upon a slant roof and an upper surface of the lower flange assembly and an upper conical portion for engaging a second portion of the perimeter wall of the service entrance pipe.

Still yet another object of the present invention is to provide a new pipe flange system that allows old and deteriorated flashings around an electrical service entrance pipe to be replaced during reproofing without disconnecting electrical service.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
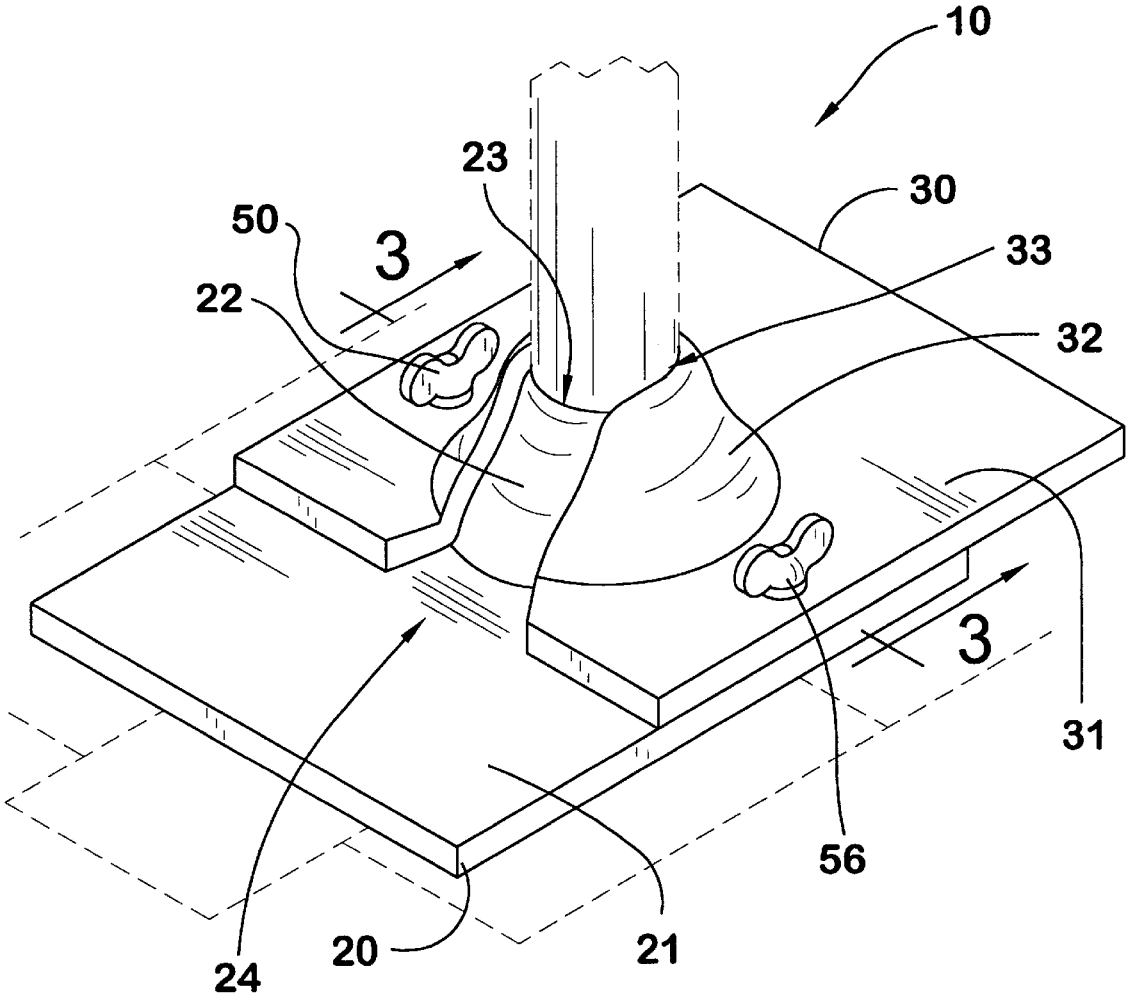
FIG. 1 is a schematic perspective view of a new pipe flange system according to the present invention.
Figure 2:
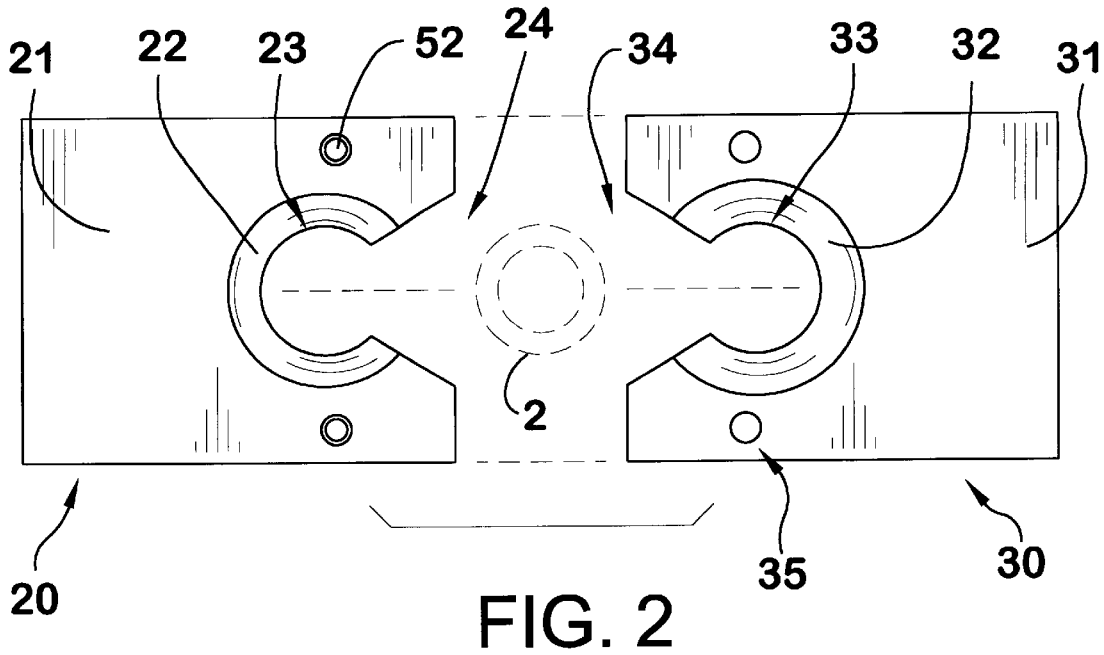
FIG. 2 is a schematic top view of the present invention.
Figure 3:
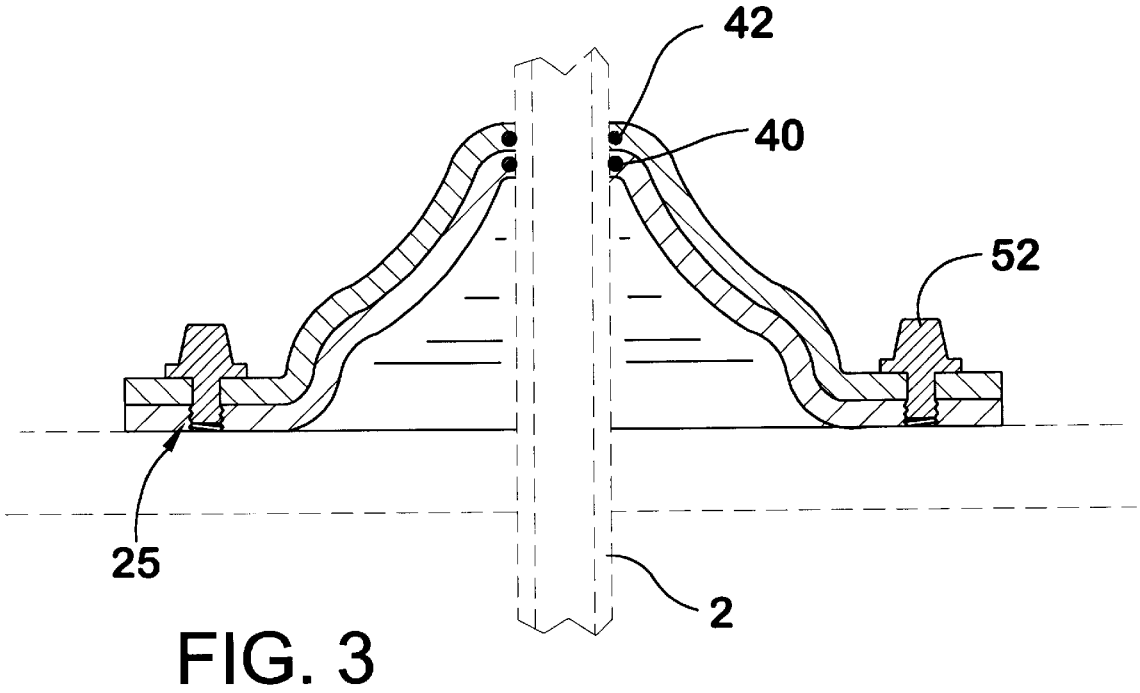
FIG. 3 is a schematic cross-sectional view of the present invention taken along line 3—3 of FIG. 1.
Figure 4:
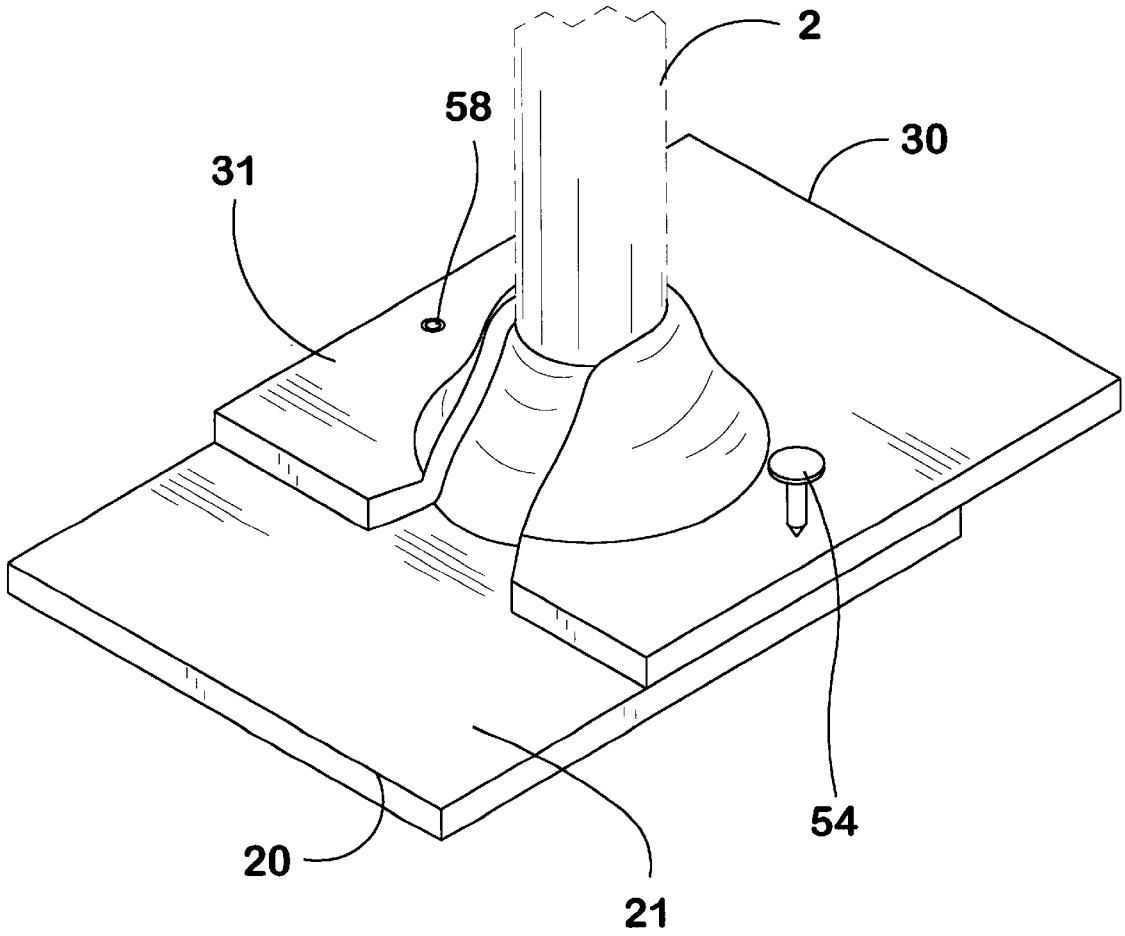
FIG. 4 is a schematic perspective view an embodiment of the present invention.

With reference now to the drawings, and in particular to FIGS. 1 through 4 thereof, a new pipe flange system embodying the principles and concepts of the present invention and generally designated by the reference numeral 10 will be described.

As best illustrated in FIGS. 1 through 4, the pipe flange system 10 generally comprises a lower flange assembly 20, and upper flange assembly 30, and a fastening means 50.

The lower flange assembly 20 is used to engage an entrance pipe 2. The lower flange assembly 20 includes a lower base portion 21 designed for resting upon a slant roof 4. The lower flange assembly 20 also includes a lower conical portion 22 for engaging a portion of a perimeter wall of the service entrance pipe 2.

The lower conical section 22 extends upwardly from the lower base portion 21. The lower conical section 22 includes an aperture 23 positioned medially. The lower base portion 21 includes an entrance channel 24, which extends outwardly from the conical section 22 through a side for facilitating sliding the lower conical section 22 to abut the portion of the perimeter wall of the service entrance pipe 2.

Similarly, the upper flange assembly 30 is also for engaging the entrance pipe 2. The upper flange assembly 30 includes an upper base portion 31 designed for resting upon a slant roof 4 and an upper surface of the lower flange assembly 20. The upper flange assembly 30 includes an upper conical portion 32 for engaging a second portion of the perimeter wall of the service entrance pipe 2.

The upper conical section 32 extends upwardly from the upper base portion 31. The upper conical section 32 includes an aperture 33 positioned medially. The upper base portion 31 includes an entrance channel 34, which extends outwardly from the upper conical section 32 through a side for facilitating sliding the upper conical section 32 to abut the second portion of the perimeter wall of the service entrance pipe 2. A bottom surface of the upper conical section 32 abuts a top surface of the lower conical member 22.

The fastening means 50 is used for facilitating coupling the upper flange assembly 30 to the lower flange assembly 20.

In an embodiment, the lower flange member 20 includes a pair of apertures 25, which extend through the lower base portion 21. Each one of the pair of apertures 25 includes threads applied on an interior surface. Similarly, the upper flange member 30, also includes a pair of upper apertures 35 extending through the upper base portion 31. The upper apertures 35 are alignable with the apertures 25 when the lower 20 and upper flange members 30 engage the service entrance pipe 2. The fastening means 50, further comprises a pair of threaded stud members 52. Each one of the pair of threaded stud members 52 is insertable through an associated one of the upper apertures 35 into an associated one of the apertures 25. Each one of the threaded stud members 52 threadedly engaging an associated one of the apertures 25. Thus, the upper flange member 30 is coupled to the lower flange member 20.

In a further embodiment, the fastening means 50 further comprises a threaded stud member 52 and a fastening means 54. The threaded stud member 52 extends upwardly from the lower base member 21. A lower aperture 25 extends through the lower base member 21. A pair of upper apertures 35 extends through the upper base member 31. A first one of the upper apertures 35 is alignable with the threaded stud member 52 when the upper 30 and lower flange members 20 engage the service entrance pipe 2. A second one of the upper apertures 35 is alignable with the lower aperture 25 when the upper 30 and lower flange members 20 engage the service entrance pipe 2. The fastening member 54 is insertable through the aligned upper 35 and lower apertures 25. Thus, the upper flange member 30 is coupled to the lower flange member 20 and the slant roof 4.

In still a further embodiment, the fastening means 50 further comprises a pair of stud members 52 and a pair of nuts 56. Each one of the pair of pair of stud members 52 extends upwardly from the lower base member 21. A pair of apertures 35 extends through the upper base member 31. Each one of the apertures 35 is alignable with an associated one of the pair of stud members 52 when the upper 30 and lower flange members 20 engage the service entrance pipe 2. Each nut 56 threadedly engages an associated one of the stud members 52 when extending through the pair of apertures 35 of the upper base member 31. Thus, the upper flange member 30 is coupled to the lower flange member 20.

In yet a further embodiment the fastening means 50 further comprises a rivet member 58 and a fastening member 54. The rivet member 58 is used to pivotally couple the upper flange member 30 to the lower flange member 20. A lower aperture 25 extends through the lower base member 21. The lower aperture 25 is positioned substantially opposite of the rivet member 58. An upper aperture 35 extends through the upper base member 31. The upper aperture 35 is positioned substantially opposite of the rivet member 58. The upper aperture 35 is alignable with the lower aperture 25 when the upper 30 and lower flange members 20 engage the service entrance pipe 2. The fastening member 54 is insertable through the aligned upper 35 and lower apertures 35. Thus, the upper flange member 30 is coupled to the lower flange member 20 and the slant roof 4.

A first seal member 40 is coupled to an interior surface of the lower conical member 32. The first seal member 40 provides an environmental barrier when the lower flange member 20 engages the service entrance pipe 2.

A second seal member 42 is similarly coupled to an interior surface of the upper conical member 32. The second seal member 42 provides an environmental barrier when the upper flange member 30 engages the service entrance pipe 2.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pipe flange system for use on slat roof projects with electrical service entrance pipes comprising:

a lower flange assembly for engaging an entrance pipe, said lower flange assembly having a lower base portion adapted for resting upon a slant roof, said lower flange assembly having a lower conical portion for engaging a portion of a perimeter wall of the service entrance pipe;

an upper flange assembly for engaging an entrance pipe, said upper flange assembly having an upper base portion adapted for resting upon a slant roof and an upper surface of said lower flange assembly, said upper flange assembly having an upper conical portion for engaging a second portion of the perimeter wall of the service entrance pipe; and said lower conical section extending upwardly from said lower base portion, said lower conical section having an aperture positioned medially, said lower base portion having an entrance channel extending outwardly from said conical section through a side for facilitating sliding said lower conical section to abut the portion of the perimeter wall of the service entrance pipe.

2. A pipe flange system for use on slat roof projects with electrical service entrance pipes comprising:

a lower flange assembly for engaging an entrance pipe, said lower flange assembly having a lower base portion adapted for resting upon a slant roof, said lower flange assembly having a lower conical portion for engaging a portion of a perimeter wall of the service entrance pipe;

an upper flange assembly for engaging an entrance pipe, said upper flange assembly having an upper base portion adapted for resting upon a slant roof and an upper surface of said lower flange assembly, said upper flange assembly having an upper conical portion for engaging a second portion of the perimeter wall of the service entrance pipe; and said upper conical section extending upwardly from said upper base portion, said upper conical section having an aperture positioned medially, said upper base portion having an entrance channel extending outwardly from said upper conical section through a side for facilitating sliding said upper conical section to abut the second portion of the perimeter wall of the service entrance pipe.

3. A pipe flange system for use on slat roof projects with electrical service entrance pipes comprising:

a lower flange assembly for engaging an entrance pipe, said lower flange assembly having a lower base portion adapted for resting upon a slant roof, said lower flange assembly having a lower conical portion for engaging a portion of a perimeter wall of the service entrance pipe;

an upper flange assembly for engaging an entrance pipe, said upper flange assembly having an upper base portion adapted for resting upon a slant roof and an upper surface of said lower flange assembly, said upper flange assembly having an upper conical portion for engaging a second portion of the perimeter wall of the service entrance pipe;

wherein said lower conical section extending upwardly from said lower base portion, said lower conical section having an aperture positioned medially, said lower base portion having an entrance channel extending outwardly from said conical section through a side for facilitating sliding said lower conical section to abut the portion of the perimeter wall of the service entrance pipe;

wherein said upper conical section extending upwardly from said upper base portion, said upper conical section having an aperture positioned medially, said upper base portion having an entrance channel extending outwardly from said upper conical section through a side for facilitating sliding said upper conical section to abut the second portion of the perimeter wall of the service entrance pipe, a bottom surface of said upper conical section abutting a top surface of said lower conical member.

4. The system of claim 3, further comprising a fastening means for facilitating coupling said upper flange assembly to said lower flange assembly.

5. The system of claim 4, wherein said fastening means further comprises:

said lower flange member having a pair of apertures extending through said lower base portion, each one of said pair of apertures having threads applied on an interior surface;

said upper flange member having a pair of upper apertures extending through said upper base portion, said upper apertures being alignable with said apertures when said lower and upper flange members engage the service entrance pipe;

a pair of threaded stud members, each one of said pair of threaded stud members being insertable through an associated one of said upper apertures into an associated one of said apertures, each one of said threaded stud members threadedly engaging an associated one of said apertures whereby said upper flange member is coupled to said lower flange member.

6. The system of claim 4, wherein said fastening means further comprises:

a threaded stud member extending upwardly from said lower base member, a lower aperture extending through said lower base member;

a pair of upper apertures extending through said upper base member, a first one of said upper apertures being alignable with said threaded stud member when said upper and lower flange members engage the service entrance pipe, a second one of said upper apertures being alignable with said lower aperture when said upper and lower flange members engage the service entrance pipe;

a fastening member insertable through said aligned upper and lower apertures whereby said upper flange member being coupled to said lower flange member and the slant roof.

7. The system of claim 4, wherein said fastening means further comprises:

a pair of stud members extending upwardly from said lower base member;

a pair of apertures extending through said upper base member, each one of said apertures being alignable with an associated one of said pair of stud members when said upper and lower flange members engage the service entrance pipe;

a pair of nuts, each nut threadedly engaging an associated one of said stud members when extending through said pair of apertures of said upper base member whereby said upper flange member being coupled to said lower flange member.

8. The system of claim 4, wherein said fastening means further comprises:

a rivet member pivotally coupling said upper flange member to said lower flange member;

a lower aperture extending through said lower base member, said lower aperture being positioned substantially opposite of said rivet member;

an upper aperture extending through said upper base member, said upper aperture being positioned substantially opposite of said rivet member, said upper aperture being alignable with said lower aperture when said upper and lower flange members engage the service entrance pipe;

a fastening member insertable through said aligned upper and lower apertures whereby said upper flange member being coupled to said lower flange member and the slant roof.

9. The system of claim 4, further comprising:

a first seal member coupled to an interior surface of said lower conical member, and first seal member providing an environmental barrier when said lower flange member engages the service entrance pipe;

a second seal member coupled to an interior surface of said upper conical member, said second seal member providing an environmental barrier when said upper flange member engages the service entrance pipe.

* * * * *